United States Patent [19]

den Ouden

[11] Patent Number: 5,056,379

[45] Date of Patent: Oct. 15, 1991

[54] REMOTE CONTROL OF ENGINE FUNCTIONS

[75] Inventor: Willem H. den Ouden, Rotterdam, Netherlands

[73] Assignee: W. H. den Ouden N.V., Schiedam, Netherlands

[21] Appl. No.: 442,557

[22] Filed: Nov. 29, 1989

[30] Foreign Application Priority Data

Aug. 30, 1989 [NL] Netherlands ..... 8902185

[51] Int. Cl.[5] ..... G05G 7/02

[52] U.S. Cl. ..... 74/858; 74/875; 74/480 B; 74/DIG. 8

[58] Field of Search ..... 74/858, 872, 875, 480 R, 74/480 B, DIG. 2, DIG. 8

[56] References Cited

U.S. PATENT DOCUMENTS

| | | | |
|---|---|---|---|
| 2,171,715 | 9/1939 | Sinclair | 74/875 |
| 2,404,545 | 7/1946 | Stevens | 74/DIG. 8 X |
| 2,919,772 | 1/1960 | Morse | 74/875 |
| 3,220,281 | 11/1965 | Irgens | 74/875 |
| 3,640,155 | 2/1972 | Waner et al. | 74/875 |
| 4,565,529 | 1/1986 | Aertker et al. | 440/7 |
| 4,683,778 | 8/1987 | Pfalzgraf | 74/DIG. 8 X |
| 4,730,507 | 3/1988 | Kobelt | 74/480 B |

*Primary Examiner*—Allan D. Herrmann
*Assistant Examiner*—Benjamin Levi
*Attorney, Agent, or Firm*—Foley & Lardner

[57] ABSTRACT

A device for the remote control of engine functions comprising two control units, each control unit having a system consisting of an output shaft coupled with a first control potentiometer, a swiveling gear wheel segment which is coupled with the output shaft and which is connected to a push-pull cable the other end of which is connected to an operating lever of the engine, and adjusting motor coupled with the output shaft, an electronic control circuit for the adjusting motor, and a control mechanism connected to each control unit by means of an electric cable which is also connected to the electronic control circuit. The control mechanism has a second control potentiometer coupled to an operating handle, whereby the electronic control circuit compares the electric signals derived from the first and said control potentiometers and energizes the adjusting motors when the difference exceeds a given threshold value.

3 Claims, 4 Drawing Sheets

REMOTE CONTROL OF ENGINE FUNCTIONS

BACKGROUND OF THE INVENTION

1. Field of the Invention

The invention relates to a device for the remote control of engine functions using push-pull cables connected to operating levers of a fuel engine.

2. Description of the Related Art

In the case of ship-diesel and petrol engines, as well as other engines such as those used for current generators, it is often desirable or necessary that important motor functions be remotely controlled. In the case of diesel and petro engines the important motor function generally concerns the fuel injection (gas control), while in the case of ship engines it is additionally desirable to remotely control the reverse clutch. In practice, use is made of relatively long push-pull cables consisting of an outside cover in which an inner cable can move or slide. One end of the push-pull cable is connected to an engine function operating lever of the engine and the other end of the cable is connected to an operating handle remotely positioned from the engine, so that by moving this handle a given engine function can be controlled.

A disadvantage with conventional push-pull cables is that they have to be very long resulting in excessive cable play which causes inaccuracy in controlling engine functions.

The great cable length creates a considerable amount of friction between the inner cable and the outside cover. This friction may lead to an unequal load being present over the length of the cable resulting in the jamming and subsequent rupturing of the cable which is very undesirable where a reliable engine operation is desired. One might think of replacing the push-pull cables completely with an electronic remote control, but this would require such a severe change in engine construction that this option is not considered practical. If on the other hand, the push-pull cables are made shorter, the operating handles would have to be positioned so close to the engine that such a system would not be usable.

SUMMARY OF THE INVENTION

The object of the invention is to eliminate the disadvantage of conventional push-pull cables by providing a device where the operating handles can be positioned at great distance while the actual operating transmission takes place by the use of very short push-pull cables.

To this end, the invention provides a device for the remote control of engine functions by using push-pull cables connected to operating levers of a fuel engine, characterized by a control unit connected to direct voltage source, the control unit having a housing containing at least one control system consisting of a switch shaft coupled with a first control potentiometer, a swiveling arm mechanism coupled with the switch shaft and connected to one end of a push-pull cable which, via a bushing, is passed through the housing, the other end of the cable lying outside the housing and which is connected to an operating lever of the fuel engine, an adjusting motor coupled with the switch shaft and an electronic control circuit for the adjusting motor, and at least one control mechanism positioned remotely located from the control unit and connected to the control unit by means of an electronic cable which is connected to the electronic control circuit, said control mechanism having a housing with a second control potentiometer and with an operating handle coupled to said second potentiometer, in which the electronic control circuit is comparing the electric signals derived from said first and said second control potentiometers, the adjusting motor rotating the switching shaft when the difference exceeds a setting threshold value until the difference between the first and second potentiometers is readjusted.

According to the invention the above mentioned disadvantage of the long push-pull cables is solved by providing an electric controlled "intermediate station", to wit the control unit which takes care for the actual control of the push-pull cables. This control unit has to be positioned at a relatively short distance from the engine so that short push-pull cables will suffice. On the contrary, the control mechanism comprising the operating handles can be positioned at an arbitrary long distance from the control unit because they are connected to each other by electric cables, the length of the cables not being critical. The operation of the device is such that by swinging the operating handle of the control mechanism, the potentiometer coupled to the operating handle is rotated or slid and that by means of the adjusting motors of the control unit which are controlled by the electronic control circuit, this rotation or sliding is followed by the switching shaft with which the first control potentiometer is coupled. Thus, a corresponding swinging of the swinging arm which is coupled to the switching shaft is caused, and in turn, the push-pull cable connected to the swinging arm may perform its normal control function of the engine. Because this push-pull cable can be rather short, the push-pull cable may function in an optimum way without the disadvantages inherent to a long push-pull cable.

In a suitable way in the case of the invention, the direct voltage source can be a rechargeable 12 or 24 volts accumulator which via an electric cable is connected to the control unit. In practice such an accumulator can be connected to the current generator circuit of the engine so that during operation of the engine the accumulator is recharged.

According to a practical embodiment the swinging arm mechanism coupled with the switch shaft may consist of a gear wheel segment, the toothing of which engages the toothing of a gear wheel with which the first potentiometer is coupled. Also, the first control potentiometer can be a rotating potentiometer. Preferably the operating handle of the control mechanism will be a swinging crank and the second control potentiometer also will be a rotating potentiometer which is fixedly coupled with the swinging shaft.

Further, the electronic control circuit can be a printed circuit (PC).

The device described above is, in particular, suitable for controlling the reverse clutch and the fuel injection of a ship engine or similar engines. The preferred embodiment will be such that the control unit has two control systems, one of which is connected to a push-pull cable for the reverse clutch while the other is connected to a push-pull cable for the fuel injection.

Such an embodiment is possible when use is made of an operating mechanism having two operating handles each with a second control potentiometer coupled to it, in which one of the operating handles is controlling the one control system of the control unit and the other is controlling the other control system.

According to a preferred embodiment of the invention, the control mechanism, however, has one operating handle which, within a given angle section at both sides of a neutral position, switches the reverse clutch while outside this section controls the fuel injection, in which in the one control system of the control unit serving to control the reverse clutch, the electronic control circuit has a low threshold value for the difference between the first and second control potentiometers and the maximum rotation of the switching shaft is adjusted such that the reverse clutch is totally changed over within said angle section, and in which in the other control system serving to control the fuel injection, the electronic control circuit has a higher threshold value such that only outside the angle section will the adjusting motor connected to it switch on.

In an appropriate way said angle section can be 15° at both sides of the neutral position of the operating handle of the control mechanism.

In case of such a device it has to be observed that no unwanted switching operations may take place such as starting the engine when the reverse clutch is switched in. To that end, the control mechanism has an operating switch by which the control can only be switched on when the operating handle is in its neutral (zero) position. In this neutral position the reverse clutch is disengaged and there is no possibility of a wrong use of the engine. A safety lamp can also be present to indicate this safety position.

In practice it is desired that the motor may operate without the reverse clutch being switched in, e.g. during starting and during warming up the engine. To make this possible according to the invention it is provided that during pressing in the operating switch, the control of the reverse clutch is switched off and only the fuel injection control can be operated.

BRIEF DESCRIPTION OF THE DRAWINGS

The invention will be further described by means of an embodiment described in the drawings below.

DETAILED DESCRIPTION OF THE PREFERRED EMBODIMENTS

Figure 1:
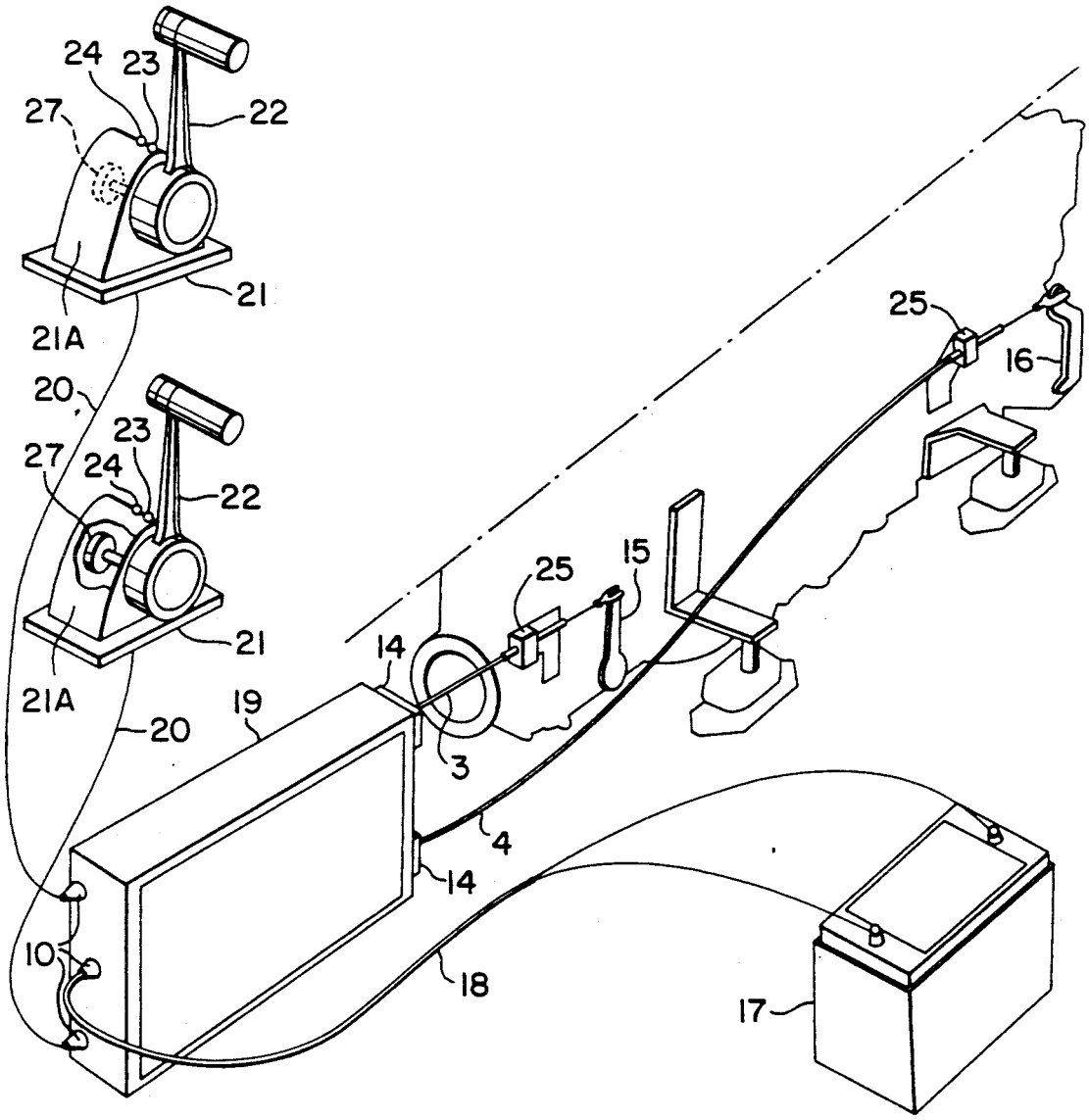
FIG. 1 illustrates a schematic view of the various main parts of a device according to the invention.
Figure 2A:
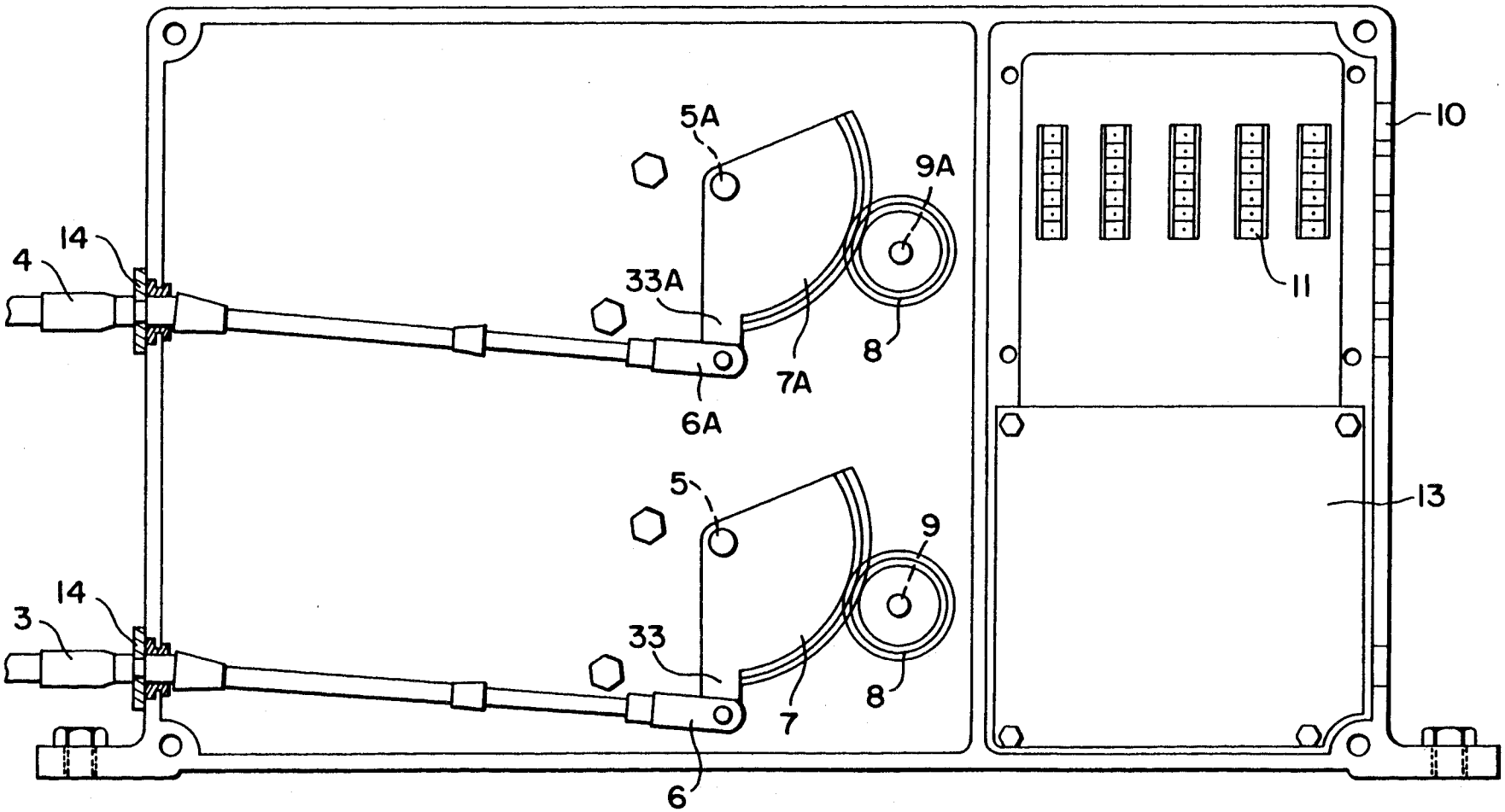
FIG. 2A shows a schematic side view in cross section of the control unit.
Figure 2B:
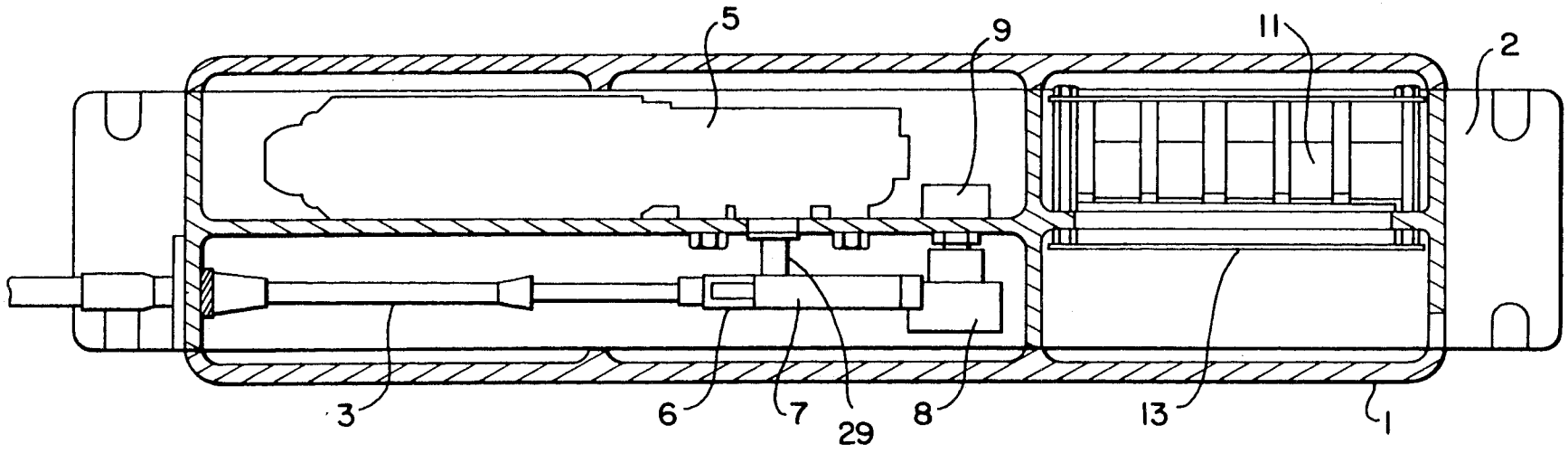
FIG. 2B shows a schematic top view in cross section of the control unit.
Figure 2C:
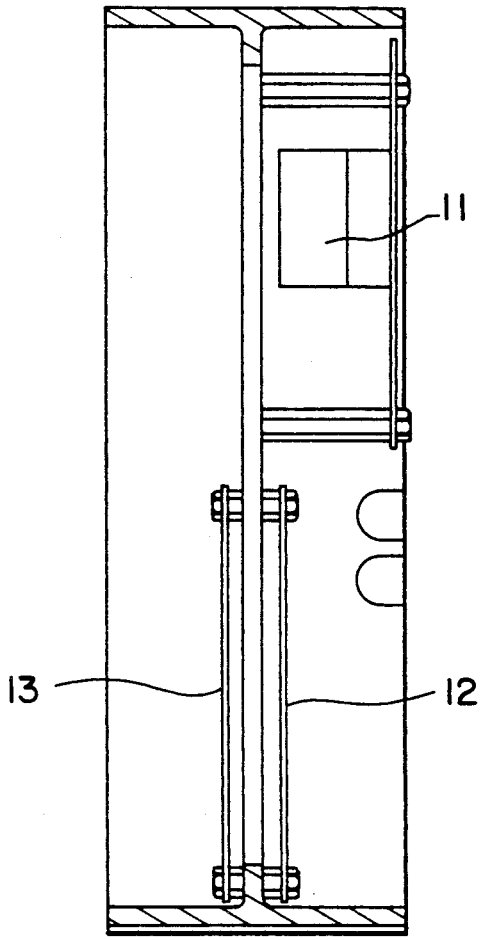
FIG. 2C shows a schematic rear view in cross section of the control unit.

As can be seen in FIG. 1, an embodiment of a remote control device according to the invention comprises, as main parts, a control unit 19, a one handle control mechanism 21, of which two are shown, and an electric direct voltage source in the shape of an accumulator 17. As can be seen in the FIGS. 2A, 2B and 2C, the control unit 19 substantially consists of a frame 2, and two covers 1, which together form the housing of control unit 19, two adjusting motors 5, 5A, two electronic control circuits 12 and 13 in the shape of printed circuits, and a plate with electric connecting blocks 11. The output shaft 29 of the two adjusting motors 5, 5A each are provided with a gear wheel segment 7, 7A, respectively, which each in turn drive potentiometers 9 and 9A, respectively, by means of a gear wheel 8. Each gear wheel 7, 7A segment has a handle portion 33, 33A, respectively.

Each handle 33, 33A of each gear wheel segment 7, 7A has a jaw end 6, 6A, respectively, mounted to it. Jaw ends 6, 6A are also mounted to two push-pull cables 3 and 4 respectively. Push-pull cables 3 and 4 by means of a connecting plate 14 have a water-tight connection with the housing of the control unit 19.

One-handle control mechanism 21 consists of a waterproof housing 21A in which a potentiometer 27 is mounted on the output shaft of which operating handle 22 is mounted. Further, housing 21A is provided with a control lamp 23 and an operating switch 24.

The electric connection between control unit 19 and each one-handle control mechanism 21 is obtained by means of multi-core electric cables 20 which are connected to the electric connecting blocks 11 via a cable bushing 10.

The energy for the whole system is delivered by a 12 volt or 24 volt direct voltage source accumulator (battery) 17. This accumulator is rechargeable and is usually recharged by a current generator of the ship or by an industry engine. During the use of the electronic engine control system, the engine will be in operation recharging the generator and also the accumulator.

The electric connection between direct voltage source 17 and control unit 19 consists of two electric supply cables 18.

The connection between control unit 19 and the fuel injection pump of the engine is obtained via push-pull cable 4, and the connection between the control unit 17 and the reverse clutch of the engine is obtained via push-pull cable 3.

Push-pull cables 3, 4 consist of an outside cover in which an inner cable can be moved back and forth. The maximum stroke of the inner cable is 76.2 mm. The outside cover of the cable is connected to the frame 2 by means of connecting plates 14 and to the engine by means of mounting blocks 25. The inner cable is connected to gear wheel segments 7, 7A of adjusting motors 5, 5A by means of the jaw ends 6, 6A, respectively. The inner cable of push-pull cable 3 is connected to the control lever 15 of the reverse clutch while the inner cable of push-pull cable 4 is connected to the control lever 16 of the fuel injection pump or carburetor.

The device described above operates as follows: In the electric connection 18 between accumulator 17 and control unit 19, an electric main switch will have to be present. When this main switch is switched on, electronic control circuits 12 and 13 will be provided with current.

By switching on operating switch 24 of one of one-handle control mechanisms 21, the related one-handle control mechanism 21 is operable. The operating switch 24 can only be switched over when operating handle 22 is in its neutral (zero) position and when this happens, the control lamp 23 will turn on, indicating that the one-handle control mechanism 21 can be used.

Requiring that operating handle 22 be in its neutral position is done for safety considerations. When operating handle 22 is in its neutral position, control lever 15 of the reverse clutch will also be in its neutral position (in the middle of its stroke) while control lever 16 of the fuel injection pump or carburetor will be at the beginning or the end of its stroke and either will be stationary.

When operating handle 22 is moved forward, e.g. is swung over 15°, the potentiometer 27 that is coupled to it will take another position. The position of potentiometer 27 does not correspond with the position of potentiometer 9. The electronic control circuit 12 will process the reference signal receive by it and will control the related adjusting motor 5 to bring the gear wheel segment 7 in a position corresponding with that of the potentiometer 27 of the one-handle control mechanism 21. Because the handle of gear wheel segment 7 moves, it will take jaw end 6 with it as well as the inner cable of push-pull cable 3, so that control lever 15 takes another position. This position can be the "forward" or "rearward" position of the reverse clutch. Usually, the above is designed so that when the operating handle 22 is moved forward, the reverse clutch will move to its "forward" position, whereas by moving the operating handle 22 rearward, the reverse clutch will be switched to a "rearward" position.

During the above mentioned actions, the push-pull cable 4 is not being moved and remains in its stationary position. If the operating handle 22 is moved more than the first 15°, the potentiometer 27 will take another position which will not correspond with the position of potentiometer 9A, associated with push-pull cable 4. The electronic control circuit 13 will process the reference signal received by it and will control the related adjusting motor 5A to bring the gear wheel segment 7A in a position corresponding with that of the potentiometer 27 in the one-handle control mechanism. Because the handle of gear wheel segment 7A moves, it will take jaw end 6A with it as well as the inner cable of push-pull cable 4 so that control lever 16 of the fuel injection or carburetor will take another position. The engine is thus opened out and will rotate faster.

SUMMARIZING

When operating handle 22 is moved forward over the first 15° of the stroke, the reverse clutch will be switched "forward". When operating handle 22 is moved forward beyond 15° and up to about 90°, the engine will be opened out.

When operating handle 22 is moved rearward over the first 15° of the stroke, the reverse clutch will be switched "rearward". When operating handle 22 is moved rearward beyond 15°, the engine will be opened out.

If operating switch 24 is switched on (only possible when operating handle is in its neutral position), the related one-handle control mechanism 21 can be used. When the operating switch 24 is held pressed on, the reverse clutch will not be switched in during the forward or rearward movement of the operating handle 22 over the first 15°. However, when the operating handle 22 is moved more than 15°, when the operating switch 24 is pressed on, the engine is only opened out. This switching out of the reverse clutch is necessary, for example, when starting or warming up the engine.

When operating handle 22 is moved fast, adjusting motors 5 and 5A will move fast. Conversely, when operating handle 22 moves slow, adjusting motors 5, 5A will move slow. This movement is controlled by electronic circuits 12 and 13.

Electronic circuits 12 and 13 are provided with the necessary protection to prevent overheating of the adjusting motors 5, 5A as well as to prevent overheating of the electronic circuits 12, 13. This can be made visible via the control lamp 23. Only one one-handle control mechanism 21 can be in operation at one time.

Many modifications of the above described system are possible.

The control mechanism 21 can be provided with one operating handle 22 for the control of the fuel and reverse clutch of one motor (one control unit).

It is also possible that the control mechanism 21 can have two operating handles 22 for controlling the fuel and reverse clutch of two motors, in which case two control units are necessary.

The embodiment can also be such that the operating mechanism has two operating handles 22 for controlling one motor. In this case, one operating handle 22 controls the fuel while the other handle would control the reverse clutch (in which case one control unit is used).

When the above mentioned control units are coupled to various control mechanisms 21, the motors can be controlled from a number of different places.

When the electric main switch is switched off, the whole system will be switched off.

The electronic control circuits 12 and 13, being printed circuits, can be provided with a locking circuit preventing the engine from starting when operating handle 22 is in such a position that the reverse clutch is being switched forward or rearward. This is a so-called starting protection. By means of the device according to the invention, a favorable way of eliminating the need for long and difficult to install push-pull cables has been invented. The device according to the invention only requires very short push-pull cables, which are easy to install. The distance between control unit 19 to control mechanism 21 is bridged by electric multi-core cables which are easy to install and do not have any of the aforementioned problems associated with push-pull cables.

By means of the electronic control circuits 12 and 13, the possibility exists to adjust the stroke length of both push-pull cables 3, 4. Normally this stroke length is 76 mm, but it can be adjusted to vary from 45 mm to 76 mm. Further, electronic circuits 12 and 13 can be provided with time delay circuitry which can be important in emergency situations. For example, suppose that a ship is running forward at maximum speed and a situation occurs in which the ship suddenly has to be run rearward. Operating handle 22 will be moved instantly from full throttle forward to full throttle rearward, which does not allow the engine time to run stationary during the switching of the reverse clutch. In this situation, a considerable amount of damage may occur to the reverse clutch, propeller shaft or other items. By providing a time delay, the engine has the opportunity to reach its idle speed prior to the reverse clutch being switched over. Depending on the speed of the engine, the time delay will be a few seconds or more. In the case of maximum speed, a longer time delay is required, while in the case of a speed just above idle speed, only a few seconds are required.

I claim:

1. An apparatus for remotely controlling engine functions using push-pull cables which are connected to operating levers of an engine, comprising:

a) a control unit connected to a direct voltage source, said control unit comprising a housing, and at least one control system, said control system comprising an output shaft, an adjusting motor coupled to said output shaft, a first control potentiometer, a swiveling gear wheel segment which is coupled to said output shaft and which engages a gear wheel which is in turn coupled to said first potentiometer, a push-pull cable having first and second ends connected to said gear wheel segment and to a fuel engine control lever, respectively, said push-pull cable passing through a cable bushing disposed in said housing, and an electronic control circuit connected to said adjusting motor; and (b) at least one control mechanism remotely positioned from said control unit and connected to said electronic control circuit by a first electric cable, said control mechanism having a housing with a second control potentiometer disposed therein and an operating handle, coupled to said second potentiometer, for controlling said first control mechanism;

wherein said electronic control circuit includes means for comparing first and second electrical signals received from said first and second potentiometers, respectively, and wherein said adjusting motor includes means for rotating said output shaft when said means for comparing detects a difference between said electrical signals which exceeds a threshold value; and wherein said control unit further comprises a second control system which is connected to an engine reverse clutch lever and which includes means for adjusting said engine reverse clutch layer;

wherein said operating handle is rotatable from a neutral position in which a reverse clutch connected to said operating handle is disengaged and a control of engine fuel injection is inhibited, through activating positions which are located at a predetermined angle on either side of said neutral position and in which said clutch becomes engaged, and into activated positions which are located outside of said predetermined angle and in which fuel injection of said engine is controlled;

wherein said second control system includes a second output shaft;

a second adjusting motor coupled to said second output shaft, a third control potentiometer, a swiveling gear wheel segment which is coupled to said second output shaft and which engages a gear wheel which is in turn coupled to said third potentiometer, a push-pull cable having first and second ends connected to said gear wheel segment and to a reverse clutch, respectively, said push-pull cable passing through a cable bushing disposed in said housing, and an electronic control circuit connected to said second adjusting motor;

wherein said electronic control circuit includes means for comparing second and third electrical signals received from said second and third potentiometers, respectively, and wherein said second adjusting motor includes means for rotating said second output shaft when said means for comparing detects a difference between said second and third electrical signals which exceeds a second threshold valve; and wherein said second threshold value is lower than said first threshold value and said second control system only allows said reverse clutch to switch into or out of engagement while said operating handle is in one of said activating positions, and wherein said first control system only allows control of said engine fuel injection when said operating handle is in one of said activated positions.

2. An apparatus according to claim 1, further comprising an operating switch, wherein when said operating switch is in an on position, said second control system is switched off and said first control system is switched on.

3. A method for remotely controlling engine functions comprising the steps of:

a) generating a first electrical signal via a first control potentiometer which is coupled to a gear wheel which in turn engages a swiveling gear segment coupled to an output shaft of an adjusting motor and to a first push-pull cable connected to a fuel engine control lever, b) generating a second electrical signal via a second control potentiometer coupled to an operating handle located remote from said first potentiometer;

c) comparing said first and second electrical signals to determine a difference between said first and second electrical signals;

d) actuating said adjusting motor when the difference between said first and second electrical signals exceeds a first predetermined threshold to rotate said output shaft and said gear wheel segment, thereby moving said first push-pull cable and adjusting a position of said fuel engine control lever;

e) generating a third electrical signal via a third control potentiometer which is coupled to a gear wheel which in turn engages a swiveling gear segment coupled to an output shaft of a second adjusting motor and to a second push-pull cable connected to a reverse clutch lever;

f) comparing said second and third electrical signals to determine a difference between said second and third electrical signals;

g) actuating said second electric motor when the difference between said second and third electrical signals exceeds a second predetermined threshold to rotate said second output shaft and said gear wheel segment, thereby moving said second push-pull cable and switching said reverse clutch into and out of engagement; and wherein said second threshold value is lower than said first threshold value.

* * * * *